US008026862B2

(12) United States Patent
Pendry et al.

(10) Patent No.: US 8,026,862 B2
(45) Date of Patent: Sep. 27, 2011

(54) ELECTROMAGNETIC COMPRESSION APPARATUS, METHODS, AND SYSTEMS

(75) Inventors: John Brian Pendry, Surrey (GB); David Schurig, Raleigh, NC (US); David R. Smith, Durham, NC (US)

(73) Assignee: The Invention Science Fund I, LLC

( * ) Notice: Subject to any disclaimer, the term of this patent is extended or adjusted under 35 U.S.C. 154(b) by 0 days.

(21) Appl. No.: 12/799,630

(22) Filed: Apr. 27, 2010

(65) Prior Publication Data

US 2010/0271284 A1 Oct. 28, 2010

Related U.S. Application Data

(60) Division of application No. 12/069,170, filed on Feb. 6, 2008, now Pat. No. 7,733,289, and a continuation of application No. 11/982,353, filed on Oct. 31, 2007, now Pat. No. 7,629,941.

(51) Int. Cl.
*H01Q 1/52* (2006.01)

(52) U.S. Cl. ..... 343/851; 343/841; 343/909

(58) Field of Classification Search ..... 343/851, 343/841, 909

See application file for complete search history.

(56) References Cited

U.S. PATENT DOCUMENTS

| | | | |
|---|---|---|---|
| 3,659,111 | A | 4/1972 | Weaver et al. |
| 4,105,955 | A | 8/1978 | Hayashi et al. |
| 4,143,944 | A | 3/1979 | Takahashi |
| 4,343,000 | A | 8/1982 | Macidull |
| 4,638,322 | A | 1/1987 | Lamberty |
| 4,700,196 | A | 10/1987 | Campbell et al. |
| 4,844,617 | A | 7/1989 | Kelderman et al. |
| 4,872,743 | A | 10/1989 | Baba et al. |
| 4,989,006 | A | 1/1991 | Roth |
| 5,013,143 | A | 5/1991 | Pasco |
| 5,121,227 | A | 6/1992 | Fisher et al. |
| 5,161,039 | A | 11/1992 | Schellenberg |
| 5,386,215 | A | 1/1995 | Brown |
| 5,563,739 | A | 10/1996 | Sato |
| 5,774,249 | A | 6/1998 | Shiraishi et al. |
| 5,784,507 | A | 7/1998 | Holm-Kennedy et al. |
| 5,911,018 | A | 6/1999 | Bischel et al. |
| 5,956,447 | A | 9/1999 | Zel'Dovich et al. |
| 6,072,889 | A | 6/2000 | Deaett et al. |
| 6,078,946 | A | 6/2000 | Johnson |
| 6,117,517 | A | 9/2000 | Diaz et al. |

(Continued)

FOREIGN PATENT DOCUMENTS

EP 2 019 447 A1 1/2009

(Continued)

OTHER PUBLICATIONS

U.S. Appl. No. 12/288,653, Bowers et al.

(Continued)

*Primary Examiner* — Tho G Phan

(57) ABSTRACT

Apparatus, methods, and systems provide electromagnetic compression. In some approaches the electromagnetic compression is achieved with metamaterials. In some approaches the electromagnetic compression defines an electromagnetic distance between first and second locations substantially greater than a physical distance between the first and second locations, and the first and second locations may be occupied by first and second structures (such as antennas) having an inter-structure coupling (such as a near-field coupling) that is a function of the electromagnetic distance. In some approaches the electromagnetic compression reduces the spatial extent of an antenna near field.

25 Claims, 8 Drawing Sheets

U.S. PATENT DOCUMENTS

| | | | |
|---|---|---|---|
| 6,118,908 | A | 9/2000 | Bischel et al. |
| 6,335,835 | B1 | 1/2002 | Koike |
| 6,337,125 | B1 | 1/2002 | Diaz et al. |
| 6,381,072 | B1 | 4/2002 | Burger |
| 6,441,771 | B1 | 8/2002 | Victora |
| 6,456,252 | B1 | 9/2002 | Goyette |
| 6,512,483 | B1 | 1/2003 | Holden et al. |
| 6,520,643 | B1 | 2/2003 | Holman et al. |
| 6,525,875 | B1 | 2/2003 | Lauer |
| 6,597,006 | B1 | 7/2003 | McCord et al. |
| 6,690,336 | B1 | 2/2004 | Leisten et al. |
| 6,714,061 | B2 | 3/2004 | Hareland |
| 6,791,432 | B2 | 9/2004 | Smith et al. |
| 6,870,671 | B2 | 3/2005 | Travis |
| 6,965,354 | B2 | 11/2005 | Pendry |
| 6,999,044 | B2 | 2/2006 | Durham et al. |
| 7,006,052 | B2 | 2/2006 | Delgado et al. |
| 7,218,285 | B2 | 5/2007 | Davis et al. |
| 7,265,910 | B2 | 9/2007 | Ito et al. |
| 7,339,539 | B2 | 3/2008 | Joannopoulos et al. |
| 7,348,930 | B2 | 3/2008 | Lastinger et al. |
| 7,352,941 | B2 | 4/2008 | Bratkovski et al. |
| 7,411,736 | B2 | 8/2008 | Tsukagoshi |
| 7,463,433 | B2 | 12/2008 | Tang |
| 7,489,282 | B2 | 2/2009 | Lastinger et al. |
| 7,529,030 | B2 | 5/2009 | Nishioka |
| 7,535,171 | B2 | 5/2009 | Bernkopf |
| 7,535,660 | B2 | 5/2009 | Saito |
| 7,538,946 | B2 | 5/2009 | Smith et al. |
| 7,554,741 | B2 | 6/2009 | Hamada |
| 7,643,227 | B2 | 1/2010 | Nishioka |
| 7,675,594 | B2 | 3/2010 | Lee et al. |
| 7,729,199 | B2 | 6/2010 | O'Connell |
| 7,777,962 | B2 | 8/2010 | Bowers et al. |
| 7,830,618 | B1 | 11/2010 | Bowers et al. |
| 7,834,980 | B2 | 11/2010 | Baselmans et al. |
| 7,869,131 | B2 | 1/2011 | Bowers et al. |
| 2002/0149534 | A1 | 10/2002 | Bobier |
| 2003/0052102 | A1 | 3/2003 | Amako et al. |
| 2004/0066251 | A1 | 4/2004 | Eleftheriades et al. |
| 2004/0091222 | A1 | 5/2004 | Canning et al. |
| 2004/0254474 | A1 | 12/2004 | Seibel et al. |
| 2005/0099348 | A1 | 5/2005 | Pendry |
| 2005/0221128 | A1 | 10/2005 | Kochergin |
| 2005/0225492 | A1 | 10/2005 | Metz |
| 2005/0253667 | A1 | 11/2005 | Itoh et al. |
| 2006/0028374 | A1 | 2/2006 | Fullerton |
| 2006/0039072 | A1 | 2/2006 | Ruoff et al. |
| 2006/0115212 | A1 | 6/2006 | Yanik et al. |
| 2006/0121358 | A1 | 6/2006 | Rich et al. |
| 2006/0125681 | A1 | 6/2006 | Smith et al. |
| 2006/0214113 | A1 | 9/2006 | Kleinerman |
| 2007/0109023 | A1 | 5/2007 | Beausoliel et al. |
| 2007/0124122 | A1 | 5/2007 | Freier |
| 2007/0188385 | A1 | 8/2007 | Hyde et al. |
| 2007/0188397 | A1 | 8/2007 | Parsche |
| 2007/0201805 | A1 | 8/2007 | Hamada |
| 2007/0236769 | A1 | 10/2007 | Zalevsky |
| 2007/0285314 | A1 | 12/2007 | Mortazawi et al. |
| 2008/0024792 | A1 | 1/2008 | Pendry et al. |
| 2008/0052904 | A1 | 3/2008 | Schneider et al. |
| 2008/0079638 | A1 | 4/2008 | Choi et al. |
| 2008/0165442 | A1 | 7/2008 | Cai et al. |
| 2008/0258993 | A1* | 10/2008 | Gummalla et al. ..... 343/876 |
| 2009/0040132 | A1 | 2/2009 | Sridhar et al. |
| 2009/0071537 | A1 | 3/2009 | Yavuzcetin et al. |
| 2009/0076367 | A1 | 3/2009 | Sit et al. |
| 2009/0079644 | A1 | 3/2009 | May et al. |
| 2009/0096545 | A1 | 4/2009 | O'Hara et al. |
| 2009/0116096 | A1 | 5/2009 | Zalevsky et al. |
| 2009/0135086 | A1 | 5/2009 | Fuller et al. |
| 2009/0285531 | A1 | 11/2009 | Hirose |
| 2009/0296236 | A1 | 12/2009 | Bowers et al. |
| 2010/0134898 | A1 | 6/2010 | Shalaev et al. |
| 2010/0156573 | A1 | 6/2010 | Smith et al. |
| 2010/0207012 | A1 | 8/2010 | Hyde et al. |
| 2010/0301971 | A1 | 12/2010 | Yonak et al. |
| 2010/0303123 | A1 | 12/2010 | Li |

FOREIGN PATENT DOCUMENTS

| | | | |
|---|---|---|---|
| GB | 2 382 230 | A | 5/2003 |
| JP | 2006-223193 | | 8/2006 |
| WO | WO 02/049146 | A3 | 6/2002 |
| WO | WO 03/088419 | A1 | 10/2003 |
| WO | WO 2004/093155 | A3 | 10/2004 |
| WO | WO 2006/023195 | A2 | 3/2006 |
| WO | WO 2008/115881 | A1 | 9/2008 |
| WO | WO 2008/137509 | A1 | 11/2008 |

OTHER PUBLICATIONS

U.S. Appl. No. 12/288,625, Bowers et al.
U.S. Appl. No. 12/288,428, Bowers et al.
U.S. Appl. No. 12/288,423, Bowers et al.
U.S. Appl. No. 12/286,608, Bowers et al.
U.S. Appl. No. 12/286,444, Bowers et al.
U.S. Appl. No. 12/286,387, Bowers et al.
U.S. Appl. No. 12/286,301, Bowers et al.
U.S. Appl. No. 12/283,352, Jeffrey A. Bowers et al.
U.S. Appl. No. 12/231,681, Jeffrey A. Bowers et al.
U.S. Appl. No. 12/228,153, Jeffrey A. Bowers et al.
U.S. Appl. No. 12/228,140, Jeffrey A. Bowers et al.
U.S. Appl. No. 12/221,201, Jeffrey A. Bowers et al.
U.S. Appl. No. 12/221,198, Jeffrey A. Bowers et al.
U.S. Appl. No. 12/220,705, Jeffrey A. Bowers et al.
U.S. Appl. No. 12/220,703, Jeffrey A. Bowers et al.
U.S. Appl. No. 12/214,534, Jeffrey A. Bowers et al.
U.S. Appl. No. 12/156,443, Jeffrey A. Bowers et al.
U.S. Appl. No. 12/074,248, Jordin T. Kare.
U.S. Appl. No. 12/074,247, Jordin T. Kare.
U.S. Appl. No. 11/982,353, John Brian Pendry et al.
Alvey, Graham R.et al.; "Investigation Into Techniques for Packaging Cosite Microstrip Patch Antennas Into Handheld Devices"; Antenna Technology Small Antennas and Novel Metamaterials, 2006 IEEE International Workshop; Mar. 6-8, 2006; pp. 45-48.
Balanis, Constantine A.; *Antenna Theory: Analysis and Design; 2005; 1136 pages; 3th* Edition; ISBN 047166782X; Wiley-Interscience (not provided).
Barkovskii, L.M. et al..; "The Impedance Tensor for Electromagnetic Waves in Anisotropic Media"; Journal of Applied Spect.; 1974; pp. 836-837; 20 (6); Plenum Publishing Corporation.
Cai, Wenshan et al.; "Nonmagnetic Cloak with Minimized Scattering"; Applied Physics Letters; Published Online Sep. 11, 2007; pp. 111105-1 to 111105-3; vol. 91; American Institute of Physics.
Cai, Wenshan et al.; "Optical Cloaking with Metamaterials"; Nature Photonics; Apr. 2007; pp. 224-227; vol. 1; Nature Publishing Group.
Chen, Hongsheng et al.; "Metamaterial Exhibiting Left-Handed Properties Over Multiple Frequency Bands"; Journal of Applied Physics; Nov. 1, 2004; pp. 5338-5340; vol. 96, No. 9; American Institute of Physics.
Cummer, Steven A. et al.; "Full-Wave Simulations of Electromagnetic. Cloaking Structures"; Physical Review E; 2006; pp. 036621-1 to 036621-5; vol. 74; The American Physical Society.
Dewar, G.; "A Thin Wire Array and Magnetic Host Structure with n<0"; Journal of Applied Physics; 2005; pp. 10Q101-1 to 10Q101-3; vol. 97; American Institute of Physics.
Efimov, S.P.; "Compression of Electromagnetic Waves by Anisotropic Media ('Nonreflecting' Crystal Model)"; Radiophysics and Quantum Electronics; Sep. 1978; pp. 916-920; vol. 21, No. 9; Springer New York.
Eleftheriades, George V., et al.; Planar Negative Refractive Index Media Using Periodically *L-C* Loaded Transmission Lines; IEEE Transactions on Microwave Theory and Techniques; bearing a date of Dec. 12, 2002; pp. 2702-2712; vol. 50, No. 12; ©2002 IEEE.
Enoch, Stefan et al.; "A Metamaterial for Directive Emission"; Physical Review Letters; Nov. 18, 2002; pp. 213902-1 to 213902-4; vol. 89, No. 21; The American Physical Society.
Freire, M.J., et al.; "Three dimensional sub-diffraction imaging by a planar metamaterial lens"; Microwave Conference, 2005 European; bearing a date of Oct. 4-6, 2005; pp. 1-4; vol. 2; located at . http://ieeexplore.ieee.org/search/wrappe.jsp?arnumber=1610024.

Georgakopoulos, Stavros V. et al.; "Cosite Interference Between Wire Antennas on Helicopter Structures and Rotor Modulation Effects: FDTD Versus Measurements"; IEEE Transactions on Electromagnetic Compatibility; Aug. 1999; pp. 221-233; vol. 41, No. 3; IEEE.
Ghose, Rabindra N.; "Collocation of Receivers and High-Power Broadcast Transmitters"; IEEE Transactions on Broadcasting; Jun. 1988; pp. 154-158; vol. 34, No. 2; IEEE.
Hoffman, Anthony J. et al.; "Negative refraction in semiconductor metamaterials"; Nature Materials; Dec. 2007; pp. 946-950; vol. 6; Nature Publishing Group.
Holden, Anthony; "Inside the Wavelength: Electromagnetics in the Near Field"; Foresight Exploiting the Electromagnetic Spectrum State of the Science Review; pp. 1-57; located at: http://www.foresight.gov.uk/Previous_Projects/Exploiting_the_electromagnetic_spectrum/Roberts_and_Publications/State_of_the_science_reviews/Inside_the_wavelength/EEMS_Inside_the_wavelength.pdf.
Hwang, Jiunn-Nan et al.; "Reduction of the Peak SAR in the Human Head With Metamaterials"; IEEE Transactions on Antennas and Propagation; bearing a date of Dec. 2006; pp. 3763-3770; vol. 54, No. 12; © 2006 IEEE.
Intellectual Property Office Search Report Under Section 17(6); App. No. GB0819691.7; Jun. 22, 2009; pp. 1-2 [1 of 4].
Jacob, Zubin et al.; "Optical Hyperlens: Far-field imaging beyond the diffraction limit"; Optics Express; Sep. 4, 2006; pp. 8247-8256; vol. 14, No. 18; OSA.
Kildishev, Alexander et al.; "Engineering space for light via transformation optics"; Optics Letters; Jan. 1, 2008; pp. 43-45; vol. 33, No. 1; Optical Society of America.
Kraus, John D.; Marhefka, Ronald J.; *Antennas For All Applications*; 2001; 960 pages; 3rd Edition; ISBN 0072321032; McGraw-Hill Science/Engineering/Math (not provided).
Kshertrimayum, R.S.; "A brief intro to metamaterials"; IEEE Potentials; bearing a date of Dec. 2004-Jan. 2005; vol. 23, Issue 5; pp. 44-46; IEEE.
Kwon, Do-Hoon, Werner, Douglas H.; "Restoration of antenna parameters in scattering environments using electromagnetic cloaking"; Applied Physics Letters 92; bearing a date of 2008; pp. 1-3; American Institute of Physics.
Landy, N. I., et al.; "A Perfect Metamaterial Absorber"; arXiv:0803,1670v1[cond-mat.mes-hall]; bearing a date of Mar. 11, 2008; pp. 1-6; located at http ://arx_iv.org/PS_cache/arxiv/pdf/0803/0803.1670v1.pdf.
Le, Anh Q. et al.; "An Evaluation of Collocation Interference Mitigation Approach for Shipboard Sincgars Radios"; Military Communications Conference; Nov. 7, 1995; pp. 612-616; vol. 2; IEEE.
Leonhardt, Ulf; Philbin, Thomas G.; "General Relativity in Electrical Engineering"; New Journal of Physics; 2006; pp. 1-18; vol. 8, No. 247; IOP Publishing Ltd and Deutsche Physikalische Gesellschaft.
Li, Shing Ted et al.; "EMC Analysis of a Shipboard Frequency-Hopping Communication System"; Electromagnetic Compatibility 1996, Symposium Record., IEEE 1996 International Symposium; Aug. 19-23, 1996; pp. 219-224; IEEE.
Linden, Stefan et al.; "Photonic Metamaterials: Magnetism at Optical Frequencies"; IEEE Journal of Selected Topics in Quantum Electronics; Nov./Dec. 2006; pp. 1097-1105; vol. 12, No. 6; IEEE.
Luukkonen, Olli; "Antenna Performance Enhancement Using Complex Materials"; pp. 1-8; located at : http://www.tkk.fi/Yksikot/Sahkomagnetiikka/kurssit/S-96.4620_2006/reports/antenna2.pdf.
PCT International Search Report; International App. No. PCT/US 09/01108; Nov. 16, 2009; pp. 1-2.
PCT International Search Report; International App. No. PCT/US 09/03272; pp. 1-4; Sep. 21, 2009.
PCT International Search Report; International App. No. PCT/US 09/03292; bearing a date of Aug. 6, 2009; pp. 1-3.
PCT Intellectual Property Office Search Report Under Section 17(6); App. No. GB0819691.7; Jun. 22, 2009; pp. 1-2 [2 of 4].
PCT Intellectual Property Office Search Report Under Section 17(6); App. No. GB0819691.7; Jun. 22, 2009; pp. 1-2 [3 of 4].
PCT Intellectual Property Office Search Report Under Section 17(6); App. No. GB0819691.7; Jun. 22, 2009; pp. 1-2 [4 of 4].
Pendry, J.B.; "Manipulating the Near Field with Metamaterials"; Optics & Photonics News; bearing a date of Sep. 2004; pp. 1-6.
Pendry, J.B. et al.; "Controlling Electromagnetic Fields"; Science; Jun. 23, 2006; pp. 1780-1782 (8 Total Pages including Supporting Material); vol. 312; located at: www.sciencemag.org.
Pendry, J.B. et al.; "Magnetism from Conductors and Enhanced Nonlinear Phenomena"; IEEE Transactions on Microwave Theory and Techniques; Nov. 1999; pp. 2075-2084; vol. 47, No. 11; IEEE.
Pendry, J.B.; Ramakrishna, S.A.; "Focusing Light Using Negative Refraction"; J. Phys. [Condensed Matter]; 2003; pp. 6345-6364 (pp. 1-22); vol. 15.
Pendry, John; "Metamaterials open new horizons in electromagnetism"; publication date unknown; Imperial College London; located at www.ecti.utoronto.ca/Assets/Events/PendryDispEng.pdf.
Rahm, Marco et al.; "Optical Design of Reflectionless Complex Media by Finite Embedded Coordinate Transformations"; Physical Review Letters; Feb. 15, 2008; pp. 063903-1 -063903-4; 100, 063903 (2008); The American Physical Society.
Rahmat-Samii, Yahya; "Metamaterials in Antenna Applications: Classifications, Designs and Applications"; Antenna Technology Small Antennas and Novel Metamaterials, 2006 IEEE International Workshop; Mar. 6-8, 2006; pp. 1-4; IEEE.
Rill, Michael S. et al.; "Photonic metamaterials by direct laser writing and silver chemical vapour deposition"; Nature Materials; Advance Online Publication; May 11, 2008; pp. 1-4; Nature Publishing Group.
Sacks, Zachary S. et al.; "A Perfectly Matched Anisotropic Absorber for Use as an Absorbing Boundary Condition"; IEEE Transactions on Antennas and Propagation; Dec. 1995; pp. 1460-1463; vol. 43, No. 12; IEEE.
Salandrino, Alessandro et al.; "Far-field subdiffraction optical microscopy using metamaterial crystals: Theory and simulations"; Physical Review; Aug. 15, 2006; pp. 075103-1-075103-5; 74, 075103 (2006); The American Physical Society.
Schurig, D. et al.; "Calculation of Material Properties and Ray Tracing in Transformation Media"; Optics Express; Oct. 16, 2006; pp. 9794-9804; vol. 14, No. 21.
Schurig, D. et al.; "Metamaterial Electromagnetic Cloak at Microwave Frequencies"; Science; Nov. 10, 2006; pp. 977-980 (18 Total Pages including Supporting Material); vol. 314; located at: www.sciencemamg.org.
Schurig, D. et al.; "Transformation-designed optical elements"; Optics Express; Oct. 29, 2007; pp. 14772-14782; vol. 15, No. 22; OSA.
Sears, Francis Weston; "Refraction of a Spherical Wave at a Plane Surface"; "Optics"; bearing a 5th printing date of Apr. 1958; pp. 38-43; Addison-Wesley Publishing Company; Reading, MA.
Shalaev, Vladimir M.; "Optical Negative-Index Metamaterials"; Nature Photonics; Jan. 2007; pp. 41-48; vol. 1; Nature Publishing Group.
Sievenpiper, Dan et al.; "High-Impedance Electromagnetic.Surfaces with a Forbidden Frequency Band"; IEEE Transactions on Microwave Theory and Techniques; Nov. 1999; pp. 2059-2074; vol. 47, No. 11; IEEE.
Smith, D.R. et al.; "Metamaterials and Negative Refractive Index"; Science; Aug. 6, 2004; pp. 788-792; vol. 305; located at: www.sciencemag.org.
Smith, D.R.; Schurig, D.; "Electromagnetic Wave Propagation in Media with Indefinite Permittivity and Permeability Tensors"; Physical Review Letters; Feb. 21, 2003; pp. 077405-1 to 077405-4; vol. 90, No. 7; The American Physical Society.
Smith, D. R., et al.; "Gradient index metamaterials"; Physical Review E 71, 036609; bearing a date of 2005; pp. 1-6; © 2005 The American Physical Society.
Sohn, J.R. et al.; "Comparative Study on Various Artificial Magnetic Conductors for Low-Profile Antenna"; Progress in Electromagnetics Research; 2006; pp. 27-37; vol. 61; located at: http://ceta.mit.edu/PIER/pier61/02.0601171.SK.Tae.L.pdf.
Travis, G.W.; Lenzing, H.F.; "Shipboard HF Interference: Problems and Mitigation"; Military Communications Conference 1989, MILCOM '89, Conference Record. 'Bridging the Gap Interoperability, Survivability, Security'; Oct. 15-18, 1989; pp. 106-110; vol. 1; IEEE.

Urban, Jeffrey J., et al.; "Synergism in binary nanocrystal superlattices leads to enhanced p-type conductivity in self-assembled PbTe/$Ag_2$ Te thin films"; Nature Materials; bearing a date of Feb. 2007; pp. 115-121; vol. 6; ©2007 Nature Publishing Group.
UK Intellectual Property Office; Patent Act 1977: Search Report under Sections 17; App. No. GB0819691.7; bearing a date of Jan. 16, 2009; p. 1.
Vardaxoglou et al.; "Recent advances on Metamaterials with applications in terminal and high gain array and reflector antennas"; bearing a date of 2006; IEEE; pp. 423-426.
Venskauskas, Kostas et al.; "Interference Cancellation Systems for Electromagnetically Dense Platforms"; Antennas and Propagation Society International Symposium, 1999; Aug. 1999; pp. 1612-1615; vol. 3; IEEE.
Wang, et al.; "Nanopin Plasmonic Resonator Array and Its Optical Properties"; Nano Letters; bearing a date of 2007; pp. 1076-1080; vol. 7, No. 4; American Chemical Society.
Ward, A.J.; Pendry, J.B.; "Refraction and Geometry in Maxwell's Equations"; Journal of Modern Optics; 1996; pp. 773-793; vol. 43.
Wiltshire, M.C.K., et al.; "Metamaterial endoscope for magnetic field transfer: near field imaging with magnetic wires"; Optics Express; bearing a date of Apr. 7, 2003; pp. 709-715; vol. 11, No. 7; © 2003 OSA.
Xu, Z. X., et al.; "Controllable Absorbing Structure of Metamaterial At Microwave"; Progress in Electromagnetics Research, Pier; bearing a date of 2007; pp. 117-125; vol. 69.
Yang, Fan; Rahmat-Samii, Yahya; "Microstrip Antennas Integrated with Electromagnetic Band-Gap (EBG) Structures: a Low Mutual Coupling Design for Array Applications"; IEEE Transactions on Antennas and Propagation; Oct. 2003; pp. 2936-2946; vol. 51, No. 10; IEEE.
Yang, Fan; Rahmat-Samii, Yahya; "Reflection Phase Characterizations of the EBG Ground Plane for Low Profile Wire Antenna Applications"; IEEE Transactions on Antennas and Propagation; Oct. 2003; pp. 2691-2703; vol. 51, No. 10; IEEE.
Zharov, Alexander A. et al.; "Birefringent Left-Handed Metamaterials and Perfect Lenses for Vectorial Fields"; New Journal of Physics; 2005; pp. 1-9; vol. 7; IOP Publishing Ltd. And Deutsche Physikalische Gesellschaft.
UK Intellectual Property Office Examination Report Under Section 18(3); App. No. GB0819691.7; Jun. 25, 2010 (received by our Agent on Jun. 29, 2010); pp. 1-3.
*Ariad* v. *Eli Lilly*; United States Court of Appeals for the Federal Circuit; Case No. 2008-1248; bearing a date of 2010; total of 72 pages; located at http://www.cafe.uscourts.gov/opinions/08-1248.pdf
Cowan, Ben; "FDTD modeling of photonic crystal fibers"; EE256 Final Project; received on May 14, 2010; pp. 1-7.
Driscoll, T. et al.; "Free-space microwave focusing by a negative-index gradient lens"; Applied Physics Letters; bearing a published online date of Feb. 21, 2006; printed on May 14, 2010; pp. 1-4; vol. 88, Issue 8; © 2006 American Institute of Physics.
Grzegorczyk, Tomasz M. et al.; "Refraction Laws for Anisotropic Media and Their Application to Left-Handed Metamaterials"; IEEE Transactions on Microwave Theory and Techniques; bearing a date of Apr. 2005; pp. 1443-1450; vol. 53, No. 4; © 2005 IEEE.
Padilla, Willie J. et al.; "Negative refractive index metamaterials"; Materials Today; bearing a date of Jul.-Aug. 2006; pp. 28-35; vol. 9, No. 7-8; © Elsevier Ltd. 2006.
Satoh, Hiroaki et al.; "Studies on Functional Photonic Crystal Devices Utilizing Anisotropic Medium Properties by Condensed Node Spatial Network Method"; International Symposium on Communications and Information Technologies 2004 (ISCIT 2004); bearing a date of Oct. 26-29, 2004; pp. 829-834.
Yannopapas, Vassilios et al.; "Negative refractive index metamaterials from inherently non-magnetic materials for deep infrared to terahertz frequency ranges"; Journal of Physics: Condensed Matter; bearing a date of 2005; pp. 3717-3734; vol. 17; Institute of Physics Publishing.
Padilla, Willie J. et al; "Negative refractive index metamaterials"; materialstoday; Jul.-Aug. 2006; pp. 28-35; vol. 9; No. 7-8; Elsevier Ltd.
Holden, Anthony; "Inside the Wavelength: Electromagnetics in the Near Field"; Jan. 30, 2004; Foresight Exploiting the Electromagnetic Spectrum State of the Science Review; pp. 1-57; located at: http:/www,foresight.gov.uk//Previous_Projects/Exploiting_the_electromagnetic_spectrum/Reports_and_Publications/State_of_the_science_reviews/Inside_the_wavelength/Eems_Inside_the_wavelength.pdf.
Pendry, John; "Metamaterials open new horizons in electromagnetism"; Jun. 26, 2008; Imperial College London; located at www.ecti.utoronto.ca/AssetsiEvents/PendryDispEng.pdf.
European Patent Office Supplementary European Search Report; App. No. EP 09 75 8642; Feb. 28, 2011 (received by our Agent on Mar. 2, 2011); pp. 1-5.
Alu, Andrea et al.; "Achieving transparency with plasmonic and metamaterial coatings"; Physical Review E; bearing a date of 2005; pp. 1-23; vol. 72, No. 016623; American Physical Society.
"Double Refraction and Birefringence"; CMDITRWIKI; bearing a date of Sep. 2, 2009; pp. 1-5; located at http://depts.washington.edu/cmditr/mediawiki/index.php?title+Double_Refraction_and_Birefringence.
Halim, Suria Binti; "Antenna With Metamaterial Design"; Universiti Teknologi Malaysia; bearing a date of May 2007; 88 pages; Universiti Teknologi Malaysia.
Kirchhoff, Herb; "What Are the Physical Properties of Sapphires?"; ehow.com; bearing a date of Aug. 23, 2010; pp. 1-2; located at http://www.ehow.com/print/list_6863886_physical-properties-sapphires_.html.
Pendry, J. B. et al.; "Extremely Low Frequency Plasmons in Metallic Mesostructures"; Physical Review Letters; bearing a date of Jun. 17, 1996; pp. 4773-4776; vol. 76, No. 25; The American Physical Society.
Pendry, John B. et al.; "Reversing Light With Negative Refraction"; Physics Today; bearing a date of Jun. 2004; pp. 37-43; American Institute of Physics.
Sears, Francis Weston; *Optics*; bearing a date of 1949; 386 pp.; 3rd Edition; ISBN-10: 0201069156; ISBN-13: 978-0201069150; Addison Wesley Publishing Company.
Stickel, Micah et al.; "Volumetric negative-refractive-index metamaterials based upon the shunt-node transmission-line configuration"; Journal of Applied Physics; bearing a date of 2007; pp. 094903-1-094903-7; vol. 102; American Institute of Physics.

* cited by examiner

ELECTROMAGNETIC COMPRESSION APPARATUS, METHODS, AND SYSTEMS

RELATED APPLICATIONS

For purposes of the USPTO extra-statutory requirements, the present application constitutes a division of U.S. patent application Ser. No. 12/069,170, entitled ELECTROMAGNETIC COMPRESSION APPARATUS, METHODS, AND SYSTEMS, naming John Brian Pendry, David Schurig and David R. Smith as inventors, filed Feb. 6, 2008, now U.S. Pat. No. 7,733,289 , or is an application of which a currently co-pending application is entitled to the benefit of the filing date.

For purposes of the USPTO extra-statutory requirements, the present application constitutes a continuation of application Ser. No. 11/982,353 now U.S. Pat. No. 7,629,941, entitled ELECTROMAGNETIC COMPRESSION APPARATUS, METHODS, AND SYSTEMS, naming John Brian Pendry, David Schurig and David R. Smith as inventors, filed Oct. 31, 2007 and, which issued on Dec. 8, 2009 and is an application of which a currently co-pending application(s) is entitled to the benefit of the filing date.

CROSS-REFERENCE TO RELATED APPLICATIONS

The present application is related to and claims the benefit of the earliest available effective filing date(s) from the following listed application(s) (the "Related Applications") (e.g., claims earliest available priority dates for other than provisional patent applications or claims benefits under 35 USC §119(e) for provisional patent applications, for any and all parent, grandparent, great-grandparent, etc. applications of the. Related Application(s)).

The United States Patent Office (USPTO) has published a notice to the effect that the USPTO's computer programs require that patent applicants reference both a serial number and indicate whether an application is a continuation or continuation-in-part. Stephen G. Kunin, Benefit of Prior-Filed Application , USPTO Official Gazette Mar. 18, 2003, available at http://www.uspto.gov/web/offices/com/sol/og/2003/week11/ patbene.htm. The present Applicant Entity (hereinafter "Applicant") has provided above a specific reference to the application(s)from which priority is being claimed as recited by statute. Applicant understands that the statute is unambiguous in its specific reference language and does not require either a serial number or any characterization, such as "continuation" or "continuation-in-part," for claiming priority to U.S. patent applications. Notwithstanding the foregoing, Applicant understands that the USPTO's computer programs have certain data entry requirements, and hence Applicant is designating the present application as a continuation-in-part of its parent applications as set forth above, but expressly points out that such designations are not to be construed in any way as any type of commentary and/or admission as to whether or not the present application contains any new matter in addition to the matter of its parent application(s).

All subject matter of the Related Applications and of any and all parent, grandparent, great-grandparent, etc. applications of the Related Applications is incorporated herein by reference to the extent such subject matter is not inconsistent herewith.

DETAILED DESCRIPTION

Figure 1A:
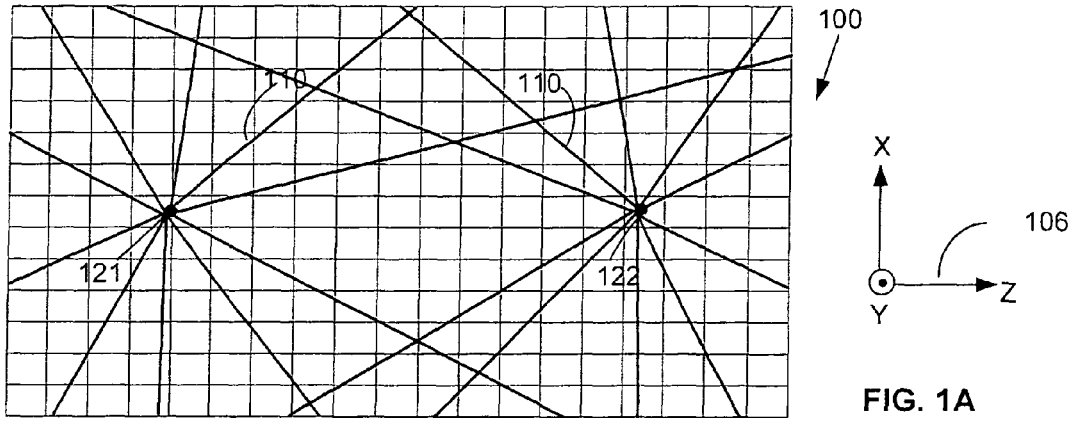
FIGS. 1A-1C depict a transformation optics example.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here.

In some applications it may be desirable to reduce the spatial extent of an electromagnetic near field, or reduce a near field coupling between two or more electromagnetic devices. Some embodiments of the invention use transformation optics to accomplish these reductions. Transformation optics is an emerging field of electromagnetic engineering. Transformation optics devices include lenses that refract electromagnetic waves, where the refraction imitates the bending of light in a curved coordinate space (a "transformation" of a flat coordinate space), e.g. as described in A. J. Ward and J. B. Pendry, "Refraction and geometry in Maxwell's equations," J. Mod. Optics 43, 773 (1996), J. B. Pendry and S. A. Ramakrishna, "Focusing light using negative refraction," J. Phys. [Cond. Matt.] 15, 6345 (2003), D. Schurig et al, "Calculation of material properties and ray tracing in transformation media," Optics Express 14, 9794 (2006) ("D. Schurig et al (1)"), and in U. Leonhardt and T. G. Philbin, "General relativity in electrical engineering," New J. Phys. 8, 247 (2006), each of which is herein incorporated by reference. The use of the term "optics" does not imply any limitation with regards to wavelength; a transformation optics device may be operable in wavelength bands that range from radio wavelengths to visible wavelengths. An exemplary transformation optics device is the electromagnetic cloak that was described, simulated, and implemented, respectively, in J. B. Pendry et al, "Controlling electromagnetic waves," Science 312, 1780 (2006); S. A. Cummer et al, "Full-wave simulations of electromagnetic cloaking structures," Phys. Rev. E 74, 036621 (2006); and D. Schurig et al, "Metamaterial electromagnetic cloak at microwave frequencies," Science 314, 977 (2006) ("D. Schurig et al (2)"); each of which is herein incorporated by reference. For the electromagnetic cloak, the curved coordinate space is the transformation of a flat space that has been punctured and stretched to create a hole (the cloaked region), and this transformation prescribes a set of constitutive parameters (electric permittivity and magnetic permeability) whereby electromagnetic waves are refracted around the hole in imitation of the curved coordinate space.

Figure 1B:
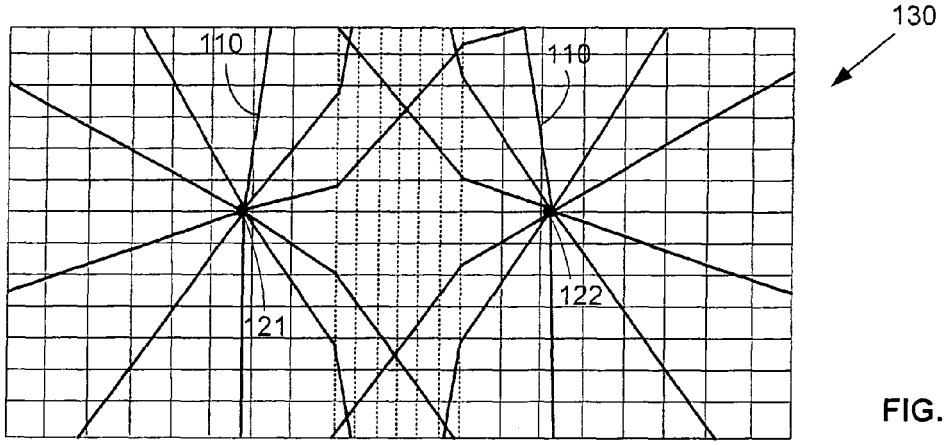
Figure 1C:
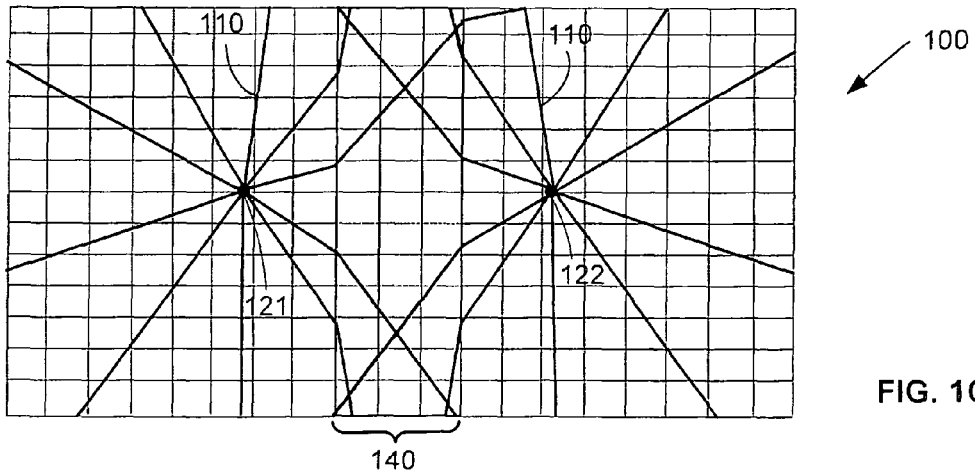

Another transformation optics example, depicted in FIGS. 1A-1C, provides a conceptual framework for embodiments of the present invention. FIG. 1A depicts a uniform medium (e.g. the vacuum, or a homogeneous material) in a flat coordinate space 100 (represented as a square grid). Electromagnetic radiation, represented diagrammatically by rays 110, radiates from first and second spatial locations 121 and 122 and propagates in straight lines through the uniform medium in the flat coordinate space. The use of a ray description is a heuristic convenience for purposes of visual illustration, and is not intended to connote any limitations or assumptions of geometrical optics. FIG. 1B depicts an imaginary scenario in which a coordinate transformation has been applied to the flat coordinate space 100 that compresses the region between the first and second spatial locations, yielding a curved coordinate space 130 (represented as a compressed grid). As a result of the coordinate transformation, the first and second spatial locations 121 and 122 are brought into a closer proximity, and the rays 110 bend at the interface between the compressed and uncompressed regions, following geodesic paths in the new, curved coordinate space.

In FIG. 1C, the flat coordinate space 100 is restored by replacing the compressed region with a slab of material ("transformation medium" 140) that refracts the electromagnetic rays 110 in a manner identical to the geometrical bending of rays in FIG. 1B. By mimicking the curved space, the transformation medium provides an effective spatial compression of the space between the first and second spatial locations 121 and 122, the effective space compression being applied along an axis joining the first and second spatial locations. The transformation medium also increases an effective electromagnetic distance between the first and second spatial locations and similarly enhances an effective geometric attenuation of electromagnetic waves that propagate through the medium (as demonstrated by the enhanced divergences of the rays as they enter the transformation medium). The constitutive parameters for the transformation medium are obtained from the equations of transformation optics:

$$\tilde{\in}^{i'j'}=|det(\Lambda_i^{i'})|^{-1}\Lambda_i^{i'}\Lambda_j^{j'}\in^{ij} \tag{1}$$

$$\tilde{\mu}^{i'j'}=|det(\Lambda_i^{i'})|^{-1}\Lambda_i^{i'}\Lambda_j^{j'}\mu^{ij} \tag{2}$$

where $\tilde{\in}$ and $\tilde{\mu}$ are the permittivity and permeability tensors of the transformation medium, $\in$ and $\mu$ are the permittivity and permeability tensors of the original medium in the untransformed coordinate space (in this example, the uniform medium of FIG. 1A), and $$\Lambda_i^{i'} = \frac{\partial x^{i'}}{\partial x^i} \tag{3}$$

is the Jacobian matrix corresponding to the coordinate transformation (i.e. from FIG. 1A to FIG. 1B in this example). In the present example, supposing that the original medium is isotropic ($\in^{ij}=\in\delta^{ij}$, $\mu^{ij}=\mu^{ij}=\mu\delta^{ij}$), the constitutive parameters of the transformation medium are given by (in the ($\hat{x}$, $\hat{y}$, $\hat{z}$) basis 106)

$$\tilde{\varepsilon} = \begin{pmatrix} s^{-1} & 0 & 0 \\ 0 & s^{-1} & 0 \\ 0 & 0 & s \end{pmatrix}\varepsilon,\ \tilde{\mu} = \begin{pmatrix} s^{-1} & 0 & 0 \\ 0 & s^{-1} & 0 \\ 0 & 0 & s \end{pmatrix}\mu \tag{4}$$

where s is the scale factor for compression (s<1) or expansion (s>1). The transformation medium matches the adjoining medium according to:

$$\frac{\tilde{\varepsilon}}{\varepsilon} = \frac{\tilde{\mu}}{\mu}. \tag{5}$$

Moreover, the surface of the illustrative transformation medium can satisfy (or substantially satisfy) the perfectly-matched layer (PML) boundary condition (cf. Z. Sacks et al, "A perfectly matched anisotropic absorber for use as an absorbing boundary condition," IEEE Trans. Ant. Prop. 43, 1460 (1995), herein incorporated by reference), so there is no reflection (or very little reflection) at the surface, regardless of the incident wave polarization or angle of incidence.

Constitutive parameters such as those in equation (4) can be realized using metamaterials. Generally speaking, electromagnetic properties of metamaterials derive from the metamaterial structures, rather than or in addition to their material composition. Some exemplary metamaterials are described in R. A. Hyde et al, "Variable metamaterial apparatus," U.S. Patent Application No. 2007/0188385; D. Smith et al, "Metamaterials," International Application No. PCT/US2005/026052; D. Smith et al, "Metamaterials and negative refractive index," Science 305, 788 (2004); and D. Smith et al, "Indefinite materials," U.S. Patent Application No. 2006/0125681; each herein incorporated by reference. Metamaterials generally feature subwavelength structures, i.e. structures having a length scale smaller than an operating wavelength of the metamaterial, and the subwavelength structures have a collective response to electromagnetic radiation that corresponds to an effective continuous medium response, characterized by an effective permittivity, an effective permeability, an effective magnetoelectric coefficient, or any combination thereof. For example, the electromagnetic radiation may induce charges and/or currents in the subwavelength structures, whereby the subwavelength structures acquire nonzero electric and/or magnetic dipole moments. Where the electric component of the electromagnetic radiation induces electric dipole moments, the metamaterial has an effective permittivity; where the magnetic component of the electromagnetic radiation induces magnetic dipole moments, the metamaterial has an effective permeability; and where the electric (magnetic) component induces magnetic (electric) dipole moments (as in a chiral metamaterial), the metamaterial has an effective magnetoelectric coefficient. Some metamaterials provide an artificial magnetic response; for example, split-ring resonators built from nonmagnetic conductors can exhibit an effective magnetic permeability (c.f. J. B. Pendry et al, "Magnetism from conductors and enhanced nonlinear phenomena," IEEE Trans. Micro. Theo. Tech. 47, 2075 (1999), herein incorporated by reference). Some metamaterials have "hybrid" electromagnetic properties that emerge partially from structural characteristics of the metamaterial, and partially from intrinsic properties of the constituent materials. For example, G. Dewar, "A thin wire array and magnetic host structure with n<0," J. Appl. Phys. 97, 10Q101 (2005), herein incorporated by reference, describes a metamaterial consisting of a wire array (exhibiting a negative permeability as a consequence of its structure) embedded in a nonconducting ferrimagnetic host medium (exhibiting an intrinsic negative permeability). Metamaterials can be designed and fabricated to exhibit selected permittivities, permeabilities, and/or magnetoelectric coefficients that depend upon material properties of the constituent materials as well as shapes, chiralities, configurations, positions, orientations, and couplings between the subwavelength structures. The selected permittivites, permeabilities, and/or magnetoelectric coefficients can be positive or negative, complex (having loss or gain), anisotropic, variable in space (as in a gradient index lens), variable in time (e.g. in response to an external or feedback signal), or any combination thereof. The selected electromagnetic properties can be provided at wavelengths that range from radio wavelengths to infrared/visible wavelengths (c.f. S. Linden et al, "Photonic metamaterials: Magnetism at optical frequencies," IEEE J. Select. Top. Quant. Elect. 12, 1097 (2006) and V. Shalaev, "Optical negative-index metamaterials," Nature Photonics 1, 41 (2007), both herein incorporated by reference).

Figure 2:
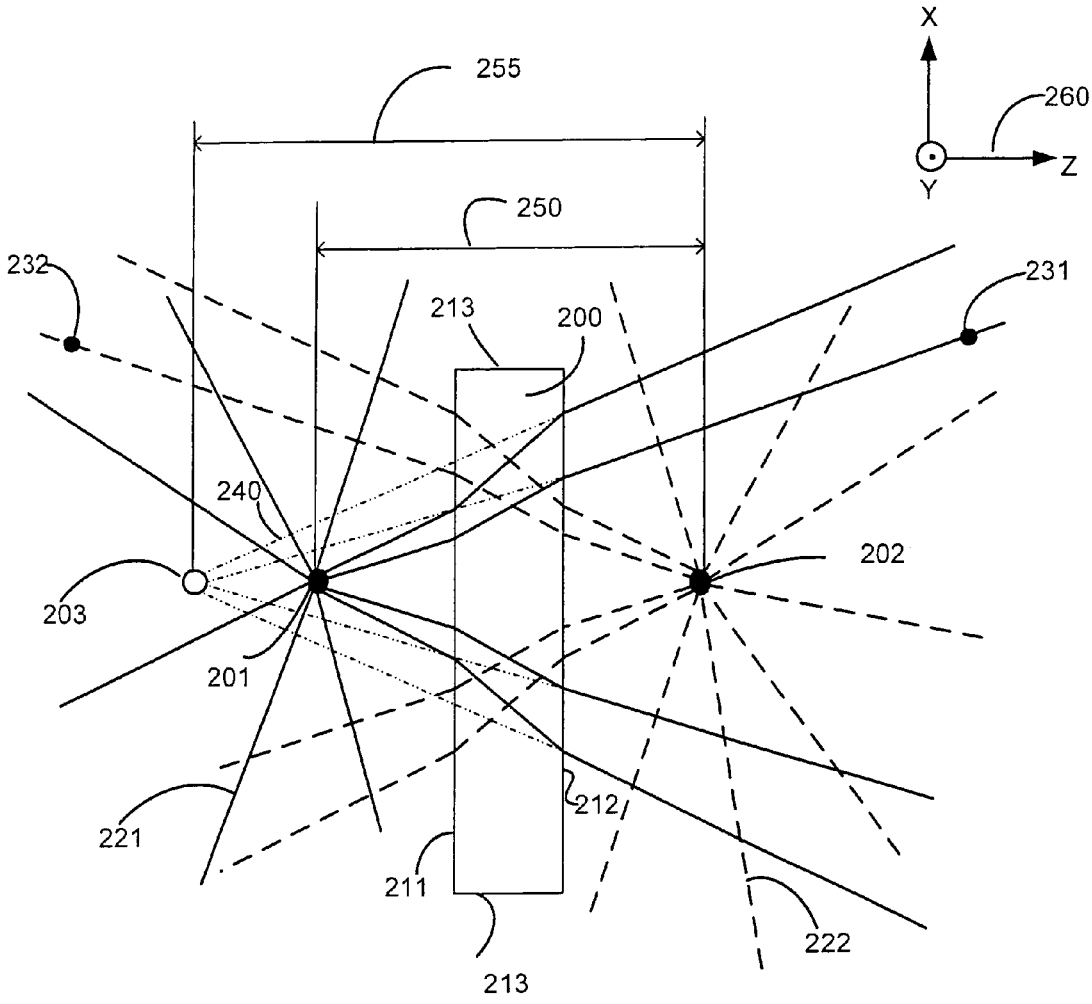
FIG. 2 depicts an electromagnetic compression structure.

In the idealized hypothetical scenario depicted in FIG. 1, the transformation medium defines a planar slab of finite thickness in the z direction, having an infinite extent in the transverse (x and y) directions. An actual embodiment of finite extent is depicted in FIG. 2, comprising an electromagnetic compression structure 200 (e.g. a metamaterial) positioned intermediate first and second spatial locations 201 and 202. The structure has first and second substantially nonreflecting surfaces 211 and 212 facing the first and second spatial locations. In some embodiments the surfaces 211 and 212 substantially satisfy perfectly-matched layer (PML) boundary conditions (for example, when the structure 200 has constitutive parameters corresponding to those of equation (4)). The surfaces 211 and 212 are depicted as parallel planar surfaces normal to an axis adjoining the first and second spatial locations (i.e. the z-axis in the figure), but other embodiments may employ non-parallel and/or non-planar surfaces (with or without appropriately generalized PML boundary conditions). The transverse extent of the structure 200 is defined by transverse surfaces 213, and electromagnetic waves incident on these surfaces may undergo reflection. The transverse surfaces 213 are depicted as parallel to the z-axis, but other embodiments employ more generic boundaries in the transverse directions (or the surfaces 211 and 212 may intersect to define a boundary). FIG. 2 can represent a cross-section of a three-dimensional embodiment (e.g. where the structure 200 is a slab or plate oriented normal to the z-axis), or a two-dimensional embodiment (e.g. where the structure 200 is positioned inside a metallic or dielectric slab waveguide oriented normal to the y-axis).

To illustrate the electromagnetic properties of the structure 200, ray trajectories 221 and 222 are depicted for electromagnetic waves that radiate from the first and second spatial locations, respectively. The use of a ray description is a heuristic convenience for purposes of visual illustration, and is not intended to connote any limitations or assumptions of geometrical optics; the structure 200 can have spatial dimensions that are less than, greater than, or comparable to a wavelength of interest. In the embodiment of FIG. 2, the rays are refracted as they pass through the surfaces 211 and/or 212 in a manner similar to that depicted in FIG. 1C, and some of the rays propagate through the structure 200 to arrive, for example, at first and second remote locations 231 and 232. Ray reflection (not depicted) may occur on the transverse surfaces 213. Rays radiating from the first spatial location 201, after propagating through the structure 200, follow subsequent trajectories that radiate from an apparent location 203 (as extrapolated with guidelines 240). Thus, the embodiment provides an effective electromagnetic distance 255 between the first and second spatial locations substantially greater than a physical distance 250 between the first and second spatial locations.

Some embodiments provide an electromagnetic compression structure, such as that depicted in FIG. 2, positioned in the vicinity of an electromagnetic device (or portion thereof). The electromagnetic device might be, for example, an emitter of electromagnetic radiation, such as a magnetron, klystron, maser, antenna, or any other device operable to radiate electromagnetic waves, including devices that emit spurious radiation (e.g. an out-of-band radiator or a poorly-shielded device, waveguide, or transmission line). Some example of antennas include wire antennas, loop antennas, biconical antennas, triangular or bow-tie antennas, long wire or Beverage antennas, V antennas, rhombic antennas, helical antennas, Yagi-Uda antennas, spiral antennas, log-periodic antennas, fractal antennas, aperture antennas, horn antennas, microstrip antennas, reflector antennas, and the like, and any combination or array thereof, including adaptive or smart antennas (unless context dictates otherwise, throughout this document the term "antenna" is intended to encompass antenna arrays and other pluralities of antenna elements). These and other antennas, and the design, application, and operation thereof, are described in further detail in C. A. Balanis, *Antenna Theory,* 3rd Edition, Wiley-Interscience, 2005 and in J. D. Krauss and R. J. Marhefka, *Antennas for All Applications,* 3rd Edition, McGraw-Hill, 2003, both herein incorporated by reference.

In general, the electromagnetic field produced by an emitter of electromagnetic radiation (such as an antenna) is typically considered according to two characteristic zones, a near field region (or Fresnel region) within some proximity of the emitter, and a far field region (or Franhofer region) outside that proximity. Suppose, for illustration (with no implied limitations as to embodiments of the invention) that the emitter is surrounded by an infinite, three dimensional, ambient medium that is either vacuum or a substantially lossless, isotropic, and homogeneous material. Within the far field region, the electromagnetic field is substantially a radiative field, in which the field components are substantially transverse to a radial vector from the emitter and fall off as 1/r with distance r, power flow (Poynting flux) is directed radially outwards and falls off as $1/r^2$ with distance r, and the shape of the field pattern is substantially independent of r. Within the near field region, in general, the electromagnetic field is a combination of the radiative field (that persists into the far field region), and other, non-radiative fields, such as quasi-static dipolar (and multipolar) fields, inductive (Biot-Savart) fields, and evanescent fields. These near field components typically diminish rapidly with distance r from the emitter; for example, evanescent fields fall off exponentially, multipole fields fall off as $1/r^{m+2}$ for moment m, and inductive fields fall off at least as $1/r^2$. The boundary between the near field and the far field generally occurs where the radiative field components and the non-radiative field components are of comparable magnitude. In some applications, this occurs at a radial distance of about $$r = \frac{2D^2}{\lambda} \tag{6}$$

where D is the largest spatial extent of the emitter, and λ is a characteristic operating wavelength (e.g. for an emitter that operates in a nominal frequency band with a mid-band frequency $\nu_m$, λ might be the wavelength corresponding to $\nu_m$ in the ambient medium that surrounds the emitter). In other applications the near field is taken to have a radius equal to some near-unity factor of λ, e.g.

$$r = k\lambda,\ \frac{1}{2\pi} \lesssim k \lesssim 10. \tag{7}$$

The lower limit (1/2π) is sometimes referred to as the radian sphere, wherein a so-called reactive near field may dominate.

In some applications is may be desirable to reduce the spatial extent of a near field. For example, the electromagnetic field may be very intense in a near field region, and this intensity might disrupt, damage, interfere, or otherwise unfavorably interact with another device, structure, or material (including biological tissue) positioned inside the near field region. Reducing the spatial extent of the near field can mitigate this disruption, damage, interference, or other unfavorable interaction, as an alternative to repositioning the interacting device, structure, or material outside the unreduced near field. Repositioning may be undesirable or impractical in applications having spatial constraints; for example, where the interacting device, structure, or material must be positioned within certain confines (e.g. on an antenna tower, aboard a vessel) and those confines are substantially or completely occupied by the near field that is to be avoided.

Figure 3A:
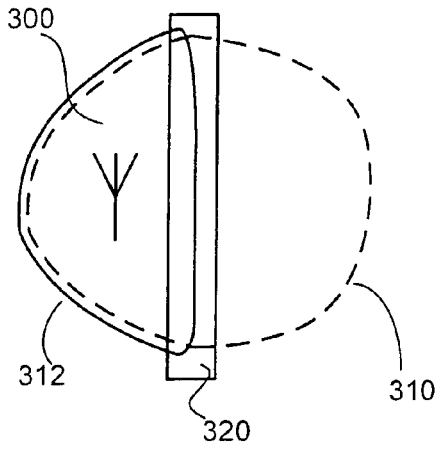
FIGS. 3A-3D depict configurations of an antenna and an electromagnetic compression structure.
Figure 3B:
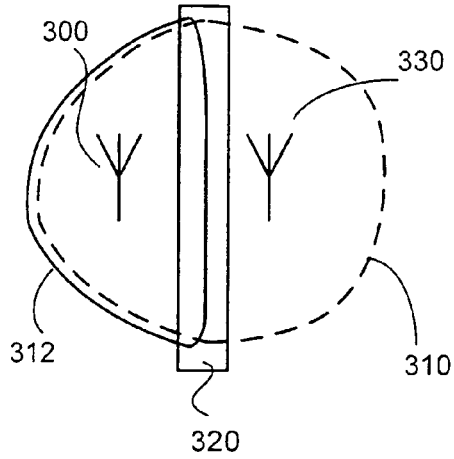
Figure 3C:
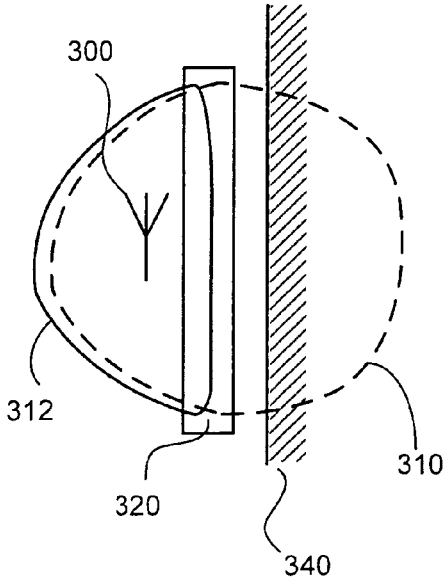
Figure 3D:
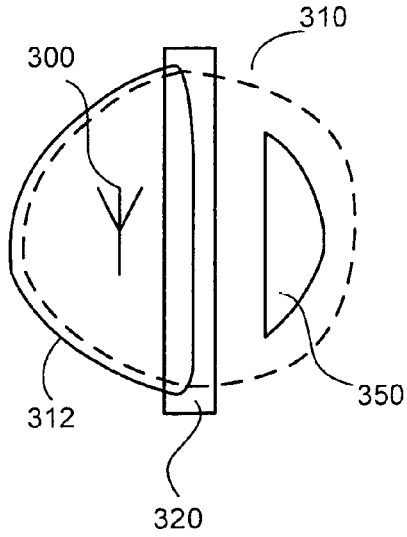

With reference now to FIG. 3A, an embodiment is depicted having an antenna 300 that defines an unadjusted near field region 310. The embodiment further includes a electromagnetic compression structure 320 positioned at least partially within the unadjusted near field 310 and operable to electromagnetically diminish the unadjusted near field region 310 to define an actual near field region 312. The antenna 300 may resemble a wire or similar antenna, but this is a symbolic depiction that is intended to encompass all manner of antennas, including array antennas, or portions thereof, including, for example, the feed portion of a larger antenna structure such as a dish antenna. Moreover, the particular shapes depicted for the unadjusted near field 310, the actual near field 312, and the electromagnetic compression structure 320 are schematic and not intended to be limiting. The structure 320 can be a metamaterial structure having properties similar to those depicted in FIG. 2, thus, for example, providing an effective space compression of the unadjusted near field region. FIG. 3B depicts another embodiment that includes a second antenna 330 positioned at least partially inside the unadjusted near field region 310 and at least partially outside the actual near field region 312. FIG. 3C depicts another embodiment that includes a surface 340 positioned at least partially inside the unadjusted near field region 310 and at least partially outside the actual near field region 312. The surface 340 might be, for example, a conductor, a dielectric, a magnetic material, a ground plane (including "artificial" ground planes such as artificial perfect magnetic conductor (PMC) surfaces and electromagnetic band gap (EBG) surfaces), or the surface of a radome material. FIG. 3D depicts another embodiment that includes a beam-shaping element 350 positioned at least partially inside the unadjusted near field region 310 and at least partially outside the actual near field region 312. The beam-shaping element (depicted, symbolically and with no implied limitation, as having a dish-like shape) is an element that is operable or responsive to electromagnetic energy to adjust a beam pattern of the antenna 300. Examples include a reflector (e.g. a parabolic dish or a Yagi-Uda reflector element), a lens (e.g. a dielectric or GRIN lens), an absorber (e.g. an anechoic material), or a directing element (e.g. a waveguide, horn, or Yagi-Uda director).

Figure 4:
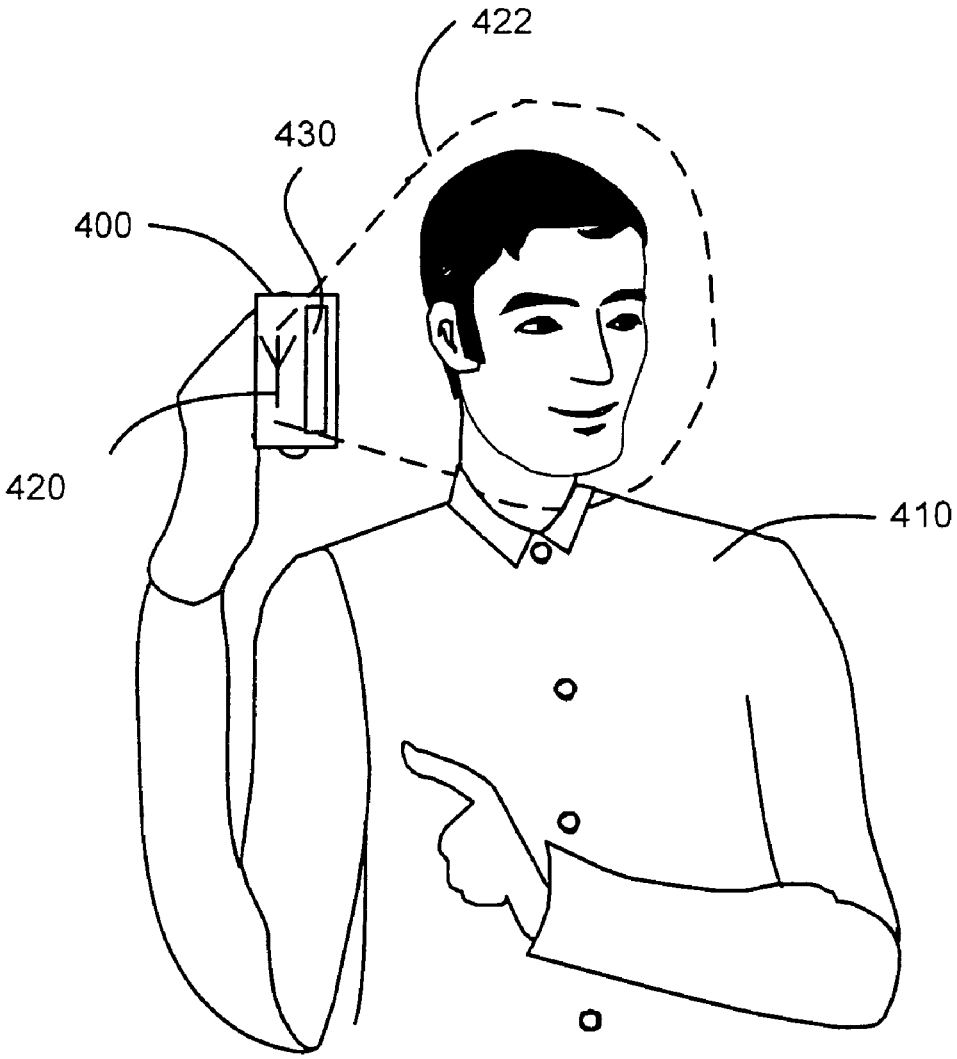
FIG. 4 depicts a hand-held device example.

In some embodiments, a near field is diminished to at least partially avoid biological tissue. For an antenna having a preferred radiation avoidance field (e.g. a region near the antenna where biological tissue may be present), embodiments provide an electromagnetic compression structure (e.g. a metamaterial structure as in FIG. 2) positioned at least partially within an unadjusted near field region of the antenna and operable to electromagnetically diminish an actual near field region of the antenna within the preferred radiation avoidance field. The preferred radiation avoidance field may be defined, for example, where the antenna is a component of a device having at least one preferred orientation for operation within a vicinity of biological matter. FIG. 4, for example, depicts a hand-held device 400 (e.g. a mobile communications device such as a cellular phone) positioned in a preferred orientation by a human operator 410 (e.g. held up to the operator's ear). Accordingly, an antenna 420 has a preferred radiation avoidance field 422, and an electromagnetic compression structure 430 is provided to reduce the spatial extent of the antenna near field within the preferred radiation avoidance field.

Figure 5:
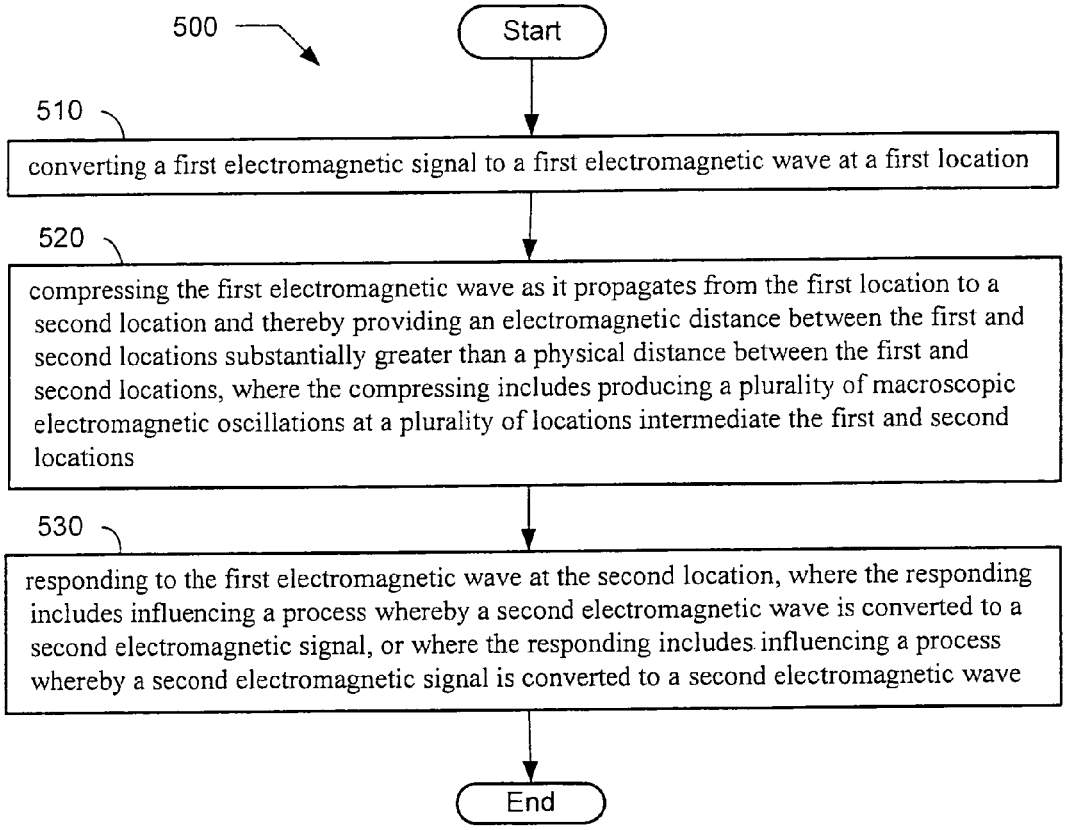
FIGS. 5-7 depict process flows.

An illustrative embodiment is depicted as a process flow diagram in FIG. 5. Flow 500 includes operation 510—converting a first electromagnetic signal to a first electromagnetic wave at a first location. For example, an antenna positioned at the first location and operating in a transmission mode can convert a current or voltage signal (e.g. from an antenna feed) into an electromagnetic wave. Flow 500 further includes operation 520—compressing the first electromagnetic wave as it propagates from the first location to a second location and thereby providing an electromagnetic distance between the first and second locations substantially greater than a physical distance between the first and second locations, where the compressing includes producing a plurality of macroscopic electromagnetic oscillations at a plurality of locations intermediate the first and second locations. For example, a metamaterial can be positioned intermediate the first and second locations, having effective electromagnetic properties such as those depicted in FIG. 2, and the metamaterial can include a plurality of artificial elements (e.g. thin wires, wire pairs, split-ring resonators, electric LC resonators, loaded transmission lines) that respond to an electromagnetic field to produce macroscopic electromagnetic oscillations (such as LC or plasmon oscillations) that may include electric and/or magnetic dipole moments. In some embodiments the artificial elements are not discrete; for example, they may be comprised of pluralities of sub-elements, where the sub-elements are discrete structures such as split-ring resonator's, etc. Flow 500 further includes operation 530—responding to the first electromagnetic wave at the second location, where the responding includes influencing a process whereby a second electromagnetic wave is converted to a second electromagnetic signal, or where the responding includes influencing a process whereby a second electromagnetic signal is converted to a second electromagnetic wave. For example, an antenna positioned at the second location may have a coupling (such as a near field or inductive coupling) to an antenna positioned at the first location, and this coupling may interfere with the operation of the antenna at the second location, for example by influencing the conversion of an electromagnetic signal to an electromagnetic wave (when the antenna at the second location is operating in a transmission mode) or influencing the conversion of an electromagnetic wave to an electromagnetic signal (when the antenna at the second location is operating in a reception mode). This influencing may be reduced by operation 520; for example, providing an electromagnetic distance between the first and second locations substantially greater than a physical distance between the first and second locations may reduce the coupling between antennas at the first and second locations, and thereby reduce the inter-antenna interference.

Figure 6:
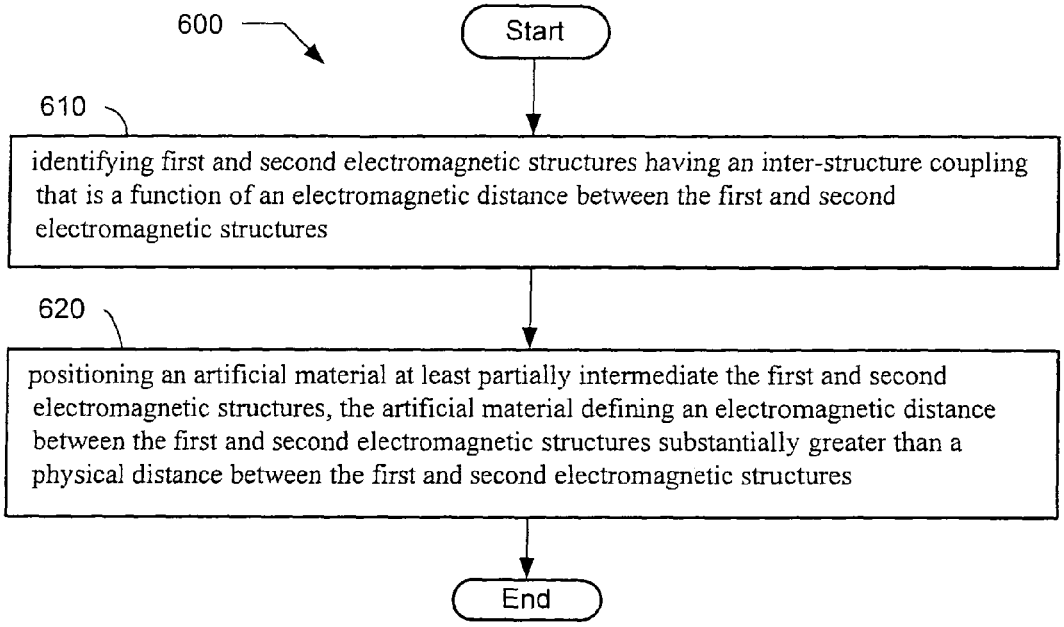

Another illustrative embodiment is depicted as a process flow diagram in FIG. 6. Flow 600 includes operation 610—identifying first and second electromagnetic structures having an inter-structure coupling that is a function of an electromagnetic distance between the first and second electromagnetic structures. For example, the first and second electromagnetic structures can be a pair of antennas having a near-field coupling, or a spuriously-radiating device (e.g. a poorly shielded electronic device) paired with a sensitive receiver or field sensor. In some embodiments the inter-structure coupling is a function of a relative orientation between the first and second electromagnetic structures, e.g. where at least one of the first and second structures is highly directional (such as an antenna with a narrow beam pattern or a device with an elongated near field). Some embodiments further include characterizing or identifying the inter-structure coupling, e.g. identifying a mutual interference between first and second antennas as a function of their relative position and/or orientation. Flow 600 further includes operation 620—positioning an artificial material at least partially intermediate the first and second electromagnetic structures, the artificial material defining an electromagnetic distance between the first and second electromagnetic structures substantially greater than a physical distance between the first and second electromagnetic structures. For example, a metamaterial having electromagnetic properties such as those depicted in FIG. 2 may be positioned intermediate the first and second electromagnetic structures. Alternatively or additionally, in some embodiments the process includes repositioning the artificial material, readjusting the properties of the artificial material (e.g. where the artificial material is an adjustable metamaterial), or otherwise modifying the artificial material (e.g. adding or removing material), thereby modifying the inter-structure coupling between the first and second electromagnetic structures. In embodiments where the inter-structure coupling influences a beam pattern of the first or second electromagnetic structure (or combination thereof), the repositioning or readjusting can thereby modify the beam pattern (e.g. by changing the direction or magnitude of a main beam or one or more side lobes).

Figure 7:
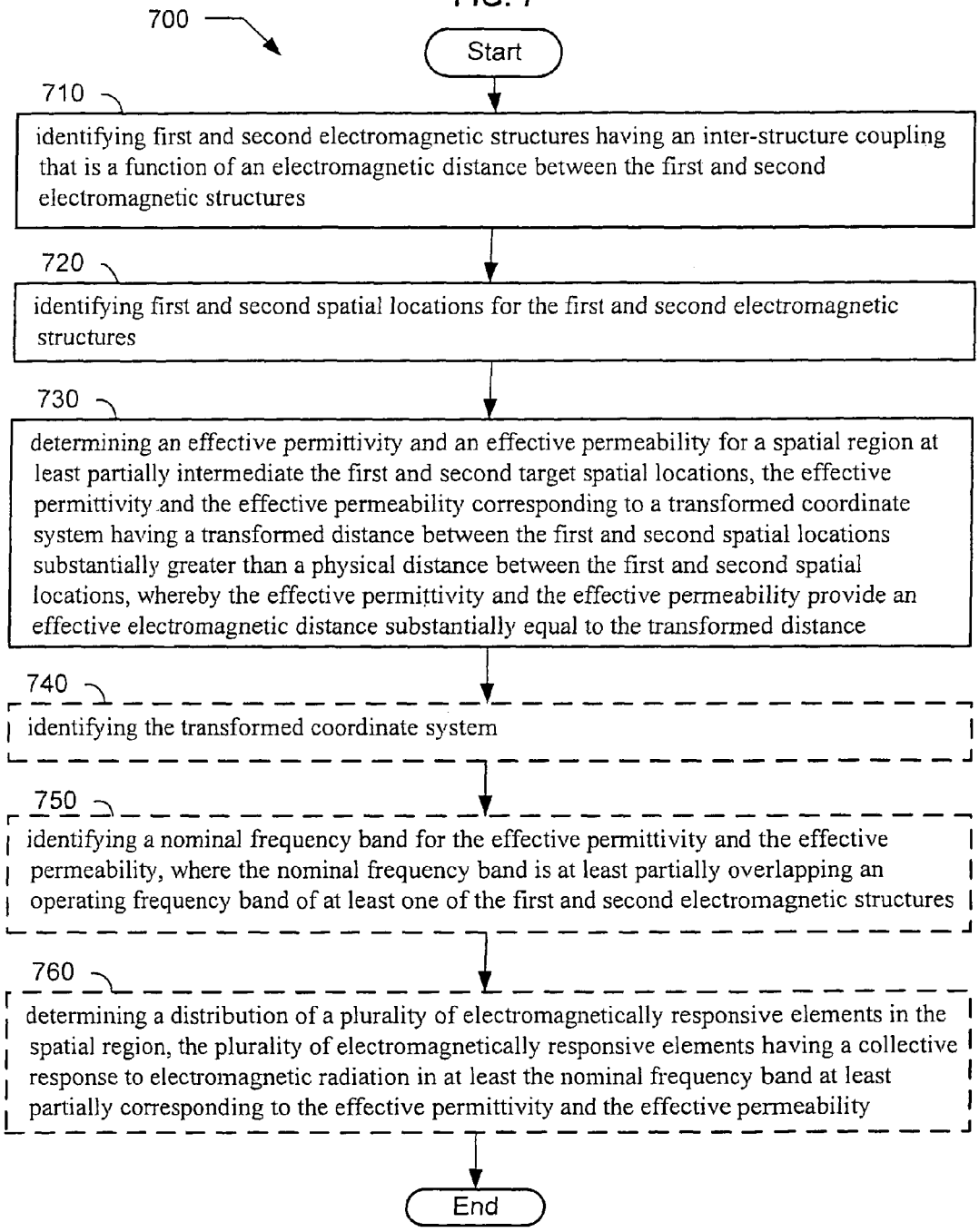

Another illustrative embodiment is depicted as a process flow diagram in FIG. 7. Flow 700 includes operation 710—identifying first and second electromagnetic structures having an inter-structure coupling that is a function of an electromagnetic distance between the first and second electromagnetic structures. For example, the first and second electromagnetic structures can be a pair of antennas having a near-field coupling, or a spuriously-radiating device (e.g. a poorly shielded electronic device) paired with a sensitive receiver or field sensor. In some embodiments the inter-structure coupling is a function of a relative orientation between the first and second electromagnetic structures, e.g. where at least one of the first and second structures is highly directional (such as an antenna with a narrow beam pattern or a device with an elongated near field). Some embodiments further include characterizing or identifying the inter-structure coupling, e.g. identifying a mutual interference between first and second antennas as a function of their relative position and/or orientation. The characterization of the inter-structure coupling can include characterizing the influence of the inter-structure coupling on a beam pattern of the first or second electromagnetic structure (or a beam pattern of the combined first and second electromagnetic structures). Some embodiments include identifying a target electromagnetic distance between the first and second electromagnetic structures, or identifying a target inter-structure coupling (or a target beam pattern as influenced by the inter-structure coupling) that corresponds to a target electromagnetic distance. Flow 700 further includes operation 720—identifying first and second spatial locations for the first and second electromagnetic structures. For example, the first and second spatial locations may be installation points on a radio tower, aboard a vessel (e.g. a boat, plane, or helicopter), inside a hand-held device, etc. In another example, the first spatial location is defined as the origin, and the second spatial location is identified as a point at a selected distance from the origin. Some embodiments include identifying first and second orientations for the first and second electromagnetic structures; for example, where the first electromagnetic structure is an antenna with a narrow beam pattern, the first orientation may exclude the second spatial location from the narrow beam pattern. Flow 700 further includes operation 730—determining an effective permittivity and an effective permeability for a spatial region at least partially intermediate the first and second target spatial locations, the effective permittivity and the effective permeability corresponding to a transformed coordinate system having a transformed distance between the first and second spatial locations substantially greater than a physical distance between the first and second spatial locations, whereby the effective permittivity and the effective permeability provide an effective electromagnetic distance substantially equal to the transformed distance (flow 700 optionally further includes operation 740—identifying the transformed coordinate system). For example, the transformation optics equations (1) and (2) may describe an effective permittivity and an effective permeability that correspond to a transformed coordinate system; exemplary constitutive relations for a uniform compression along a z-axis are given by equation (4). In those embodiments that include identifying a target electromagnetic distance between the first and second electromagnetic structures, or identifying a target inter-structure coupling (or a target beam pattern as influenced by the inter-structure coupling) that corresponds to a target electromagnetic distance, the effective electromagnetic distance can be substantially equal to the target electromagnetic distance. Flow 700 optionally further includes operation 750—identifying a nominal frequency band for the effective permittivity and the effective permeability, where the nominal frequency band is at least partially overlapping an operating frequency band of at least one of the first and second electromagnetic structures. For example, the nominal frequency band can be a radio or microwave frequency band; in some embodiments, the nominal frequency band corresponds to a spurious emission band for at least one of the first and second electromagnetic structures. Flow 700 optionally further includes operation 760—determining a distribution of a plurality of electromagnetically responsive elements in the spatial region, the plurality of electromagnetically responsive elements having a collective response to electromagnetic radiation in at least the nominal frequency band at least partially corresponding to the effective permittivity and the effective permeability. For example, the effective permittivity and the effective permeability may be provided by a metamaterial structure having a plurality of artificial elements such as split ring resonators, thin wire arrays, loaded transition lines, wire/rod/pillar pairs, etc., arranged with selected positions and orientations, and having selected spatial dimensions, resonant frequencies, linewidths, etc. as appropriate. In some embodiments the artificial elements are not discrete; for example, they may be comprised of pluralities of sub-elements, where the sub-elements are discrete structures such as split-ring resonators, etc., or the elements may be inclusions, exclusions, or other variations along some continuous structure (e.g. etchings on a substrate). In some embodiments, the process further includes disposing the plurality of electromagnetically responsive elements in the spatial region according to the determined distribution.

Figure 8:
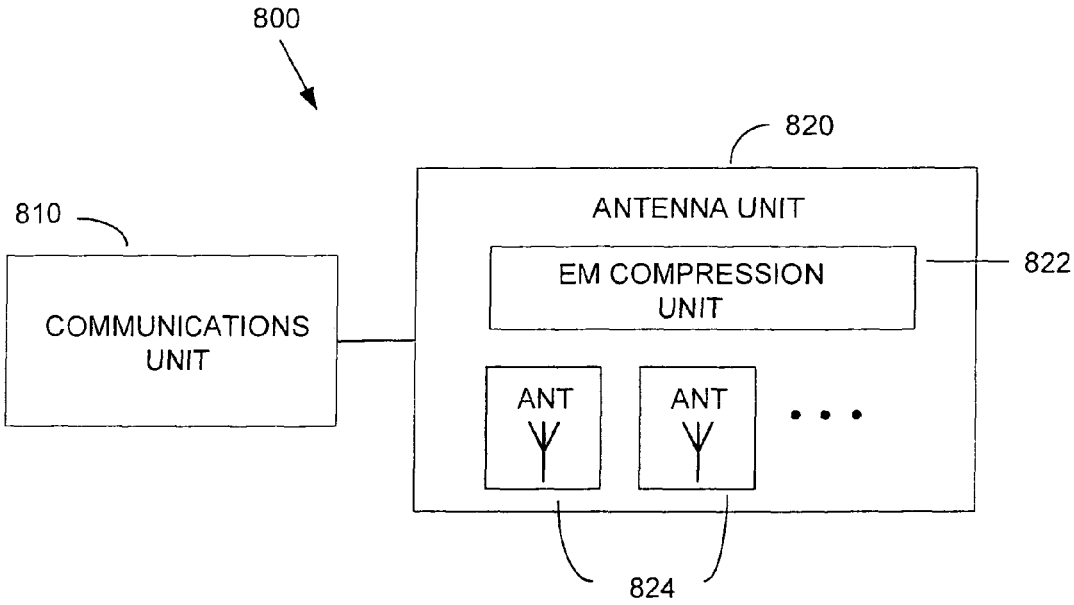
FIG. 8 depicts an electromagnetic compression system.

With reference now to FIG. 8, an illustrative embodiment is depicted as a system block diagram. The system 800 includes a communications unit 810 coupled to an antenna unit 820. The communications unit 810 might include, for example, a communications module of a wireless device such as a cellular telephone, or a transmitter, receiver, or transceiver module for radio communications system. The antenna unit 820 includes an electromagnetic compression unit 822 and one or more antennas 824. For example, the one or more antennas 824 can include one or more transmitting antennas, one or more receiving antennas, one or more bidirectional (transmit and receive) antennas, or any combination thereof, operating in one or more frequency bands and having one or more beam patterns (or cumulative beam patterns, as in a phased array). The electromagnetic compression unit 822 can include one or more electromagnetic compression structures (such as that depicted in FIG. 2) operable to reduce an inter-structure coupling between first and second antennas selected from the one or more antennas 824, and/or operable to reduce inter-structure couplings between an antenna selected from the one or more antennas 824 and another electromagnetic structure (e.g. a noisy electronics device positioned near the antenna unit 820). In some embodiments the electromagnetic compression unit can be adjusted (e.g. where the electromagnetic compression unit includes electromagnetic compression structures comprised of a variable or adjustable metamaterial) to modify one or more inter-structure couplings (or associated interference levels or beam patterns); in these embodiments the communications unit may provide one or more control signals to adjust the electromagnetic compression unit.

The foregoing detailed description has set forth various embodiments of the devices and/or processes via the use of block diagrams, flowcharts, and/or examples. Insofar as such block diagrams, flowcharts, and/or examples contain one or more functions and/or operations, it will be understood by those within the art that each function and/or operation within such block diagrams, flowcharts, or examples can be implemented, individually and/or collectively, by a wide range of hardware, software, firmware, or virtually any combination thereof. In one embodiment, several portions of the subject matter described herein may be implemented via Application Specific Integrated Circuits (ASICs), Field Programmable Gate Arrays (FPGAs), digital signal processors (DSPs), or other integrated formats. However, those skilled in the art will recognize that some aspects of the embodiments disclosed herein, in whole or in part, can be equivalently implemented in integrated circuits, as one or more computer programs running on one or more computers (e.g., as one or more programs running on one or more computer systems), as one or more programs running on one or more processors (e.g., as one or more programs running on one or more microprocessors), as firmware, or as virtually any combination thereof, and that designing the circuitry and/or writing the code for the software and or firmware would be well within the skill of one of skill in the art in light of this disclosure. In addition, those skilled in the art will appreciate that the mechanisms of the subject matter described herein are capable of being distributed as a program product in a variety of forms, and that an illustrative embodiment of the subject matter described herein applies regardless of the particular type of signal bearing medium used to actually carry out the distribution. Examples of a signal bearing medium include, but are not limited to, the following: a recordable type medium such as a floppy disk, a hard disk drive, a Compact Disc (CD), a Digital Video Disk (DVD), a digital tape, a computer memory, etc.; and a transmission type medium such as a digital and/or an analog communication medium (e.g., a fiber optic cable, a waveguide, a wired communications link, a wireless communication link, etc.).

In a general sense, those skilled in the art will recognize that the various aspects described herein which can be implemented, individually and/or collectively, by a wide range of hardware, software, firmware, or any combination thereof can be viewed as being composed of various types of "electrical circuitry." Consequently, as used herein "electrical circuitry" includes, but is not limited to, electrical circuitry having at least one discrete electrical circuit, electrical circuitry having at least one integrated circuit, electrical circuitry having at least one application specific integrated circuit, electrical circuitry forming a general purpose computing device configured by a computer program (e.g., a general purpose computer configured by a computer program which at least partially carries out processes and/or devices described herein, or a microprocessor configured by a computer program which at least partially carries out processes and/or devices described herein), electrical circuitry forming a memory device (e.g., forms of random access memory), and/or electrical circuitry forming a communications device (e.g., a modern, communications switch, or optical-electrical equipment). Those having skill in the art will recognize that the subject matter described herein may be implemented in an analog or digital fashion or some combination thereof.

All of the above U.S. patents, U.S. patent application publications, U.S. patent applications, foreign patents, foreign patent applications and non-patent publications referred to in this specification and/or listed in any Application Data Sheet, are incorporated herein by reference, to the extent not inconsistent herewith.

One skilled in the art will recognize that the herein described components (e.g., steps), devices, and objects and the discussion accompanying them are used as examples for the sake of conceptual clarity and that various configuration modifications are within the skill of those in the art. Consequently, as used herein, the specific exemplars set forth and the accompanying discussion are intended to be representative of their more general classes. In general, use of any specific exemplar herein is also intended to be representative of its class, and the non-inclusion of such specific components (e.g., steps), devices, and objects herein should not be taken as indicating that limitation is desired.

With respect to the use of substantially any plural and/or singular terms herein, those having skill in the art can translate from the plural to the singular and/or from the singular to the plural as is appropriate to the context and/or application. The various singular/plural permutations are not expressly set forth herein for sake of clarity.

While particular aspects of the present subject matter described herein have been shown and described, it will be apparent to those skilled in the art that, based upon the teachings herein, changes and modifications may be made without departing from the subject matter described herein and its broader aspects and, therefore, the appended claims are to encompass within their scope all such changes and modifications as are within the true spirit and scope of the subject matter described herein. Furthermore, it is to be understood that the invention is defined by the appended claims. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

With respect to the appended claims, those skilled in the art will appreciate that recited operations therein may generally be performed in any order. Examples of such alternate orderings may include overlapping, interleaved, interrupted, reordered, incremental, preparatory, supplemental, simultaneous, reverse, or other variant orderings, unless context dictates otherwise. With respect to context, even terms like "responsive to," "related to," or other past-tense adjectives are generally not intended to exclude such variants, unless context dictates otherwise.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. An apparatus, comprising:

a substantially-transparent electromagnetic compression structure having at least one surface that is substantially nonreflecting of electromagnetic waves in at least one frequency band with at least one selected polarization, the substantially-transparent electromagnetic compression structure operable to enhance an effective geometric attenuation of diverging electromagnetic waves incident on the at least one surface.

2. The apparatus of claim 1, wherein the effective geometric attenuation corresponds to an effective space compression along a selected axis.

3. The apparatus of claim 2, wherein the substantially transparent electromagnetic compression structure has an effective permittivity that is substantially uniaxial along the selected axis.

4. The apparatus of claim 2, wherein the substantially transparent electromagnetic compression structure has an effective permeability that is substantially uniaxial along the selected axis.

5. The apparatus of claim 4, wherein the substantially transparent electromagnetic compression structure has an effective permittivity that is substantially uniaxial along the selected axis.

6. The apparatus of claim 5, wherein the effective permittivity is substantially equal to the effective permeability.

7. The apparatus of claim 6, wherein a first substantially nondegenerate eigenvalue of the effective permittivity is substantially a multiplicative inverse of second and third substantially degenerate eigenvalues of the effective permittivity.

8. The apparatus of claim 7, where the first substantially nondegenerate eigenvalue is substantially less than unity.

9. A system, comprising:

an antenna operable in proximity to an electromagnetically responsive structure;

communications circuitry configured to receive or transmit via the antenna; and a substantially-nonreflective and substantially-transparent electromagnetic compression structure operable to provide a reduced inter-structure coupling between the antenna and the electromagnetically responsive structure.

10. The system of claim 9, further comprising the electromagnetically responsive structure.

11. The system of claim 9, wherein the reduced inter-structure coupling corresponds to an increased effective electromagnetic distance between the antenna and the electromagnetically responsive structure, the increased effective electromagnetic distance being substantially greater than a physical distance between the antenna and the electromagnetically responsive structure.

12. The system of claim 9, wherein the electromagnetically responsive structure is a spurious emitter.

13. The system of claim 9, wherein the electromagnetically responsive structure is a biological tissue.

14. The system of claim 9, wherein the antenna is a first antenna and the electromagnetically responsive structure is a second antenna.

15. The system of claim 14, further comprising the second antenna.

16. The system of claim 15, wherein the communications circuitry is further configured to receive or transmit via the second antenna.

17. The system of claim 16, wherein the communications circuitry is configured to transmit via the first antenna and to receive via the second antenna.

18. The system of claim 16, wherein the first and second antennas are first and second elements of a phased array.

19. The system of claim 9, wherein the electromagnetic compression structure operable to provide a reduced inter-structure coupling is an adjustable electromagnetic compression structure operable to provide an adjustable inter-structure coupling.

20. The system of claim 19, wherein the adjustable electromagnetic compression structure includes a plurality of adjustable metamaterial elements having adjustable individual responses, the plurality of respective adjustable individual responses providing the adjustable inter-structure coupling.

21. The system of claim 19, wherein the adjustable inter-structure coupling is adjustable in response to one or more control signals.

22. The system of claim 21, wherein the communications circuitry is further configured to provide the one or more control signals.

23. The system of claim 19, wherein the system defines a beam pattern that is a function of the reduced inter-structure coupling.

24. The system of claim 23, wherein the beam pattern is an adjustable beam pattern corresponding to the adjustable inter-structure coupling.

25. A system, comprising:

a plurality of electromagnetic responsive structures including one or more antennas;

communications circuitry configured to receive or transmit via the one or more antennas; and one or more substantially-nonreflective and substantially-transparent electromagnetic compression structures operable to provide reduced inter-structure couplings between at least some pairs of electromagnetically responsive structures selected from of the plurality of electromagnetically responsive structures.

* * * * *